United States Patent [19]

Sullaway et al.

[11] Patent Number: 4,789,271

[45] Date of Patent: Dec. 6, 1988

[54] REMOTE FLUID TRANSFER SYSTEM AND METHOD FOR SUB-SEA BASEPLATES AND TEMPLATES

[75] Inventors: Bob L. Sullaway; Lloyd C. Knox, both of Duncan; Gary D. Zunkel, Chickasha, all of Okla.

[73] Assignee: Halliburton Company, Duncan, Okla.

[21] Appl. No.: 79,313

[22] Filed: Jul. 29, 1987

Related U.S. Application Data

[63] Continuation-in-part of Ser. No. 892,163, Jul. 29, 1986, abandoned.

[51] Int. Cl.[4] ..... E02B 17/00; E02D 29/00

[52] U.S. Cl. ..... 405/225; 405/169; 405/195; 405/224

[58] Field of Search ..... 405/224, 225, 226, 227, 405/195, 169, 170, 171; 166/338, 339, 340, 341

[56] References Cited

U.S. PATENT DOCUMENTS

| | | | |
|---|---|---|---|
| 28,232 | 11/1874 | Basset et al. . | |
| 3,154,039 | 10/1964 | Knapp . | |
| 3,469,132 | 9/1969 | Harris | 405/211 |
| 3,564,856 | 2/1971 | Blount et al. | 405/225 |
| 3,648,638 | 3/1972 | Blenkara . | |
| 3,702,537 | 11/1972 | Landers . | |
| 3,780,685 | 12/1973 | Horton . | |
| 3,919,957 | 11/1975 | Ray et al. . | |
| 4,063,421 | 12/1977 | Coone et al. | 405/225 |
| 4,063,427 | 12/1977 | Hoffman | 405/225 |
| 4,077,224 | 3/1978 | Coone | 405/225 |
| 4,140,426 | 2/1979 | Knox | 405/225 |
| 4,214,843 | 7/1980 | Rohde | 405/225 |
| 4,523,878 | 6/1985 | Richart et al. | 166/340 X |

FOREIGN PATENT DOCUMENTS

| | | | |
|---|---|---|---|
| 1444160 | 7/1976 | United Kingdom | 405/225 |
| 2096674 | 8/1984 | United Kingdom | 405/225 |

OTHER PUBLICATIONS

"R.O.V. Grouting System", by Wimpey Laboratories; Oil States Industries and Sonat Subsea Services' Facilities, dated Jan. 22, 1986.

*Primary Examiner*—Dennis L. Taylor
*Attorney, Agent, or Firm*—James R. Duzan

[57] ABSTRACT

A simple, easily manipulated remote fluid transfer system comprising a pump, grout pipe string, a manipulation device, guide sleeve, and a remote video display device.

20 Claims, 4 Drawing Sheets

REMOTE FLUID TRANSFER SYSTEM AND METHOD FOR SUB-SEA BASEPLATES AND TEMPLATES

This application is a continuation-in-part of application Ser. No. 892,163, filed 7-29-86, now abandoned.

BACKGROUND OF THE INVENTION

This invention relates to an improved remote fluid transfer system for marine structures.More specifically, this invention relates to an improved remote fluid transfer packer inflation and grouting system for offshore platforms installed in deep waters where the offshore platform is anchored in position utilizing anchor pads on the sea floor or requires a remote fluid transfer system to reduce piping complexity and cost due to the size of the platform.

As offshore platforms were installed in deeper waters, it ultimately became necessary to start filling the annulus between the jacket leg and piling driven therethrough of the platform with grouting material in an attempt to add strength and rigidity to the platform. At first, these grouting jobs were run either by pumping grout into the top of the jacket leg hoping that the grout would form an annular plug and displace the water from the jacket leg as it moved downwardly therethrough or by running lines to the bottom of the jacket leg where an initial grout plug was installed in the jacket leg and left to harden with subsequent grout being placed thereon utilizing a line connected to the jacket leg above the initial grout plug. A typical example of the later grouting method and apparatus is shown in U.S. Pat. No. 3,564,856 to Blount et al.

As problems were encountered with placing grout into the water filled annulus between the jacket leg and piling driven therethrough, various grouting procedures were developed to place grout into the annulus after it has been dewatered. One type of grouting procedure involved dewatering the leg using compressed air or gas, then setting a grout plug to harden to subsequently add grout in subsequent stages on tôp the plug to fill the annulus Examples of this procedure are shown in U.S. Pat. Nos. 3,492,824 and Re. 28,232. However, since any supported plug method of grouting is subject to the initial grout plug falling out from the jacket leg in soft or muddy bottoms or no sea bottom at all being present around the jacket leg, various types of grouting procedures using mechanical or inflatable grout seals have been developed.

When using a mechanical or inflatable grout seal installed on the bottom of a jacket leg, grout is injected into the annulus in one or more stages starting from the bottom of the jacket adjacent the grout seal and as the grout flows into the annulus between the jacket leg and piling the grout displaces the water in the annulus out the top of the jacket leg. Grout is continued to be pumped into the leg during grouting operations until grout having the desired density exits the top of the jacket leg. Similarly, where mechanical or unflatable grout seals are used on pile sleeves, sleeves connected to the lower portion of the jacket having piling driven therethrough and used to add strength and stability to the platform, grout is pumped into the bottom of pile sleeve annulus adjacent the grout seal displacing the water in the annulus out the top thereof with a predetermined excess amount of grout continuing to be pumped into the annulus to over fill the same.

An early example of an inflatable grout seal used in offshore platform grouting operations in shown in U.S. Pat. No. 3,468,132. An advantage that inflatable grout seals have over mechanical grout seals, such as shown in U.S. Pat. No. 3,702,537, is that inflatable grout seals are capable of supporting a grout column hundreds of feet in length in the jacket leg annulus during grouting operations while mechanical grout seals are capable of supporting grout columns having a length of only approximately 10 feet to 50 feet typically, thereby requiring a second stage of grout to be placed on top the short hardened grout plug to fill the jacket leg annulus.

After inflatable grout seals were developed, in order to reduce the number of separate inflation lines running to each inflatable grout seal and grout lines running to jacket legs and pile sleeves on offshore platforms, systems utilizing a single line to inflate an inflatable grout seal and supply grout to a pile sleeve, or jacket leg, were developed. Such systems are typically illustrated in U.S. Pat. Nos. 4,063,421, 4,063,427, 4,077,224, and 4,140,426.

However, such single line inflation and grout systems suffer the disadvantage that it is not known whether the inflatable grout seal is properly inflated or has failed until after grout has been pumped into the pile sleeve or jacket leg annulus and the calculated amount of grout does not fill the annulus thereby requiring more grout or alternative grouting systems to be used.

In other attempts to reduce the number of grout lines and inflation lines for grout seals on platforms, particularly as offshore platforms became larger and more complex, two different approaches have been pursued.

One approach was to place a grout manifold at a remote location on the platform and have a diver intermittently connect a flexible line, such as a rubber hose, from the surface to the desired grout line. Such a system for grouting purposes only is shown in U.S. Pat. No. 4,214,843. However, for platforms in deep water it may be too difficult or too deep for a diver to connect a flexible grout line to a grout manifold or to open and close any valves used in back-up grouting systems if the primary grout system fails.

Another approach to reducing the number of grout lines and inflation lines for inflatable grout seals, is to use control valves in the grout system and inflation system so that multiple pile sleeves or jacket legs can be grouted through a single line running to the surface of the offshore platform and multiple inflatable grout seals may be inflated and tested using a single inflation line running to the surface of the offshore platform. Such inflation an grout systems are shown in U.S. Pat. No. 4,275,974. Although these types of inflation and grout systems work well and are cost effective, for any offshore platforms, inflation and grout lines still must be run to the top of the offshore platform and relied on for inflation and grouting purposes.

For deep waters it may be desired to have a floating drilling platform, production platform or other moored platform, rather than a conventional offshore platform resting on and being secured to the sea floor by piling driven through the jacket legs and pile sleeves connected thereto. Such floating structures are suggested in U.S. Pat. Nos. 3,154,039, 3,648,638, 3,780,685 and 3,919,957. Typically, such floating platforms utilize anchors to retain them in position. The anchors are typically structures utilizing, in turn, either ballasting and deballasting means to control and determine their position on the sea floor or piling driven through sleeves on the structure which is secured to the structure by grouting the sleeve annulus.

As floating platforms having anchors comprising structures utilizing piling are installed in greater water depths it has become necessary to devise apparatus and methods which would allow the remote placement of the fluids and other types of materials and grouts, and the like for securing the anchors in position.

One such apparatus and method being marketed by Wimpey Laboratories Limited and Oil States Industries Division, LTV Energy Products, discloses a system for grouting and inflating inflatable grout seals on a subsea template. The Wimpey system substitutes a remotely operated vehicle for a diver to remotely manipulate the end of a rubber hose to insert a stinger into or onto a receptacle for supply grouting material to a grout system or inflation fluid to an inflation system for inflatable grout seals and to manipulate various valves and connectors in the grout system and inflation system. One of the advantages offered by this arrangement is that the umbilical flexible hose line, a rubber hose, can be retained on a reel on a vessel and easily, quickly deployed along with a clump weight, to control buoyancy, from the vessel. However since the system utilizes permanent connectors to connect the umbilical flexible hose line to the receptacles, it is necessary to retrieve and replace the receptacle each time the grouting of a sleeve or inflation of an inflatable grout seal has been completed. Also, since this type of system replaces a diver with remotely operated vehicle, R.O.V., the R.O.V. must be used to make connections with the umbilical line, disconnect the umbilical line, guide the umbilical line, and operate various valves in the inflation system and grout system. In waters with currents and where the umbilical line is difficult to handle the R.O.V. may have to include multiple arms to cling to the template to maintain its station. Additionally, is has been found that with a neutral or slightly negative buoyancy umbilical line that it is difficult to make the connections between the male and female portions of the connectors and that if a negative buoyancy umbilical line is used, to assist in making connections, stresses quickly mount on the umbilical line thereby limiting the depths at which it can be safely used and thereby making the umbilical line difficult or impossible for the R.O.V. to handle. Furthermore, if the pneumatic type connectors are used, the umbilical line handling problems are increased as there are two separate flow lines making up the umbilical for the R.O.V. to handle and control.

Another apparatus and method proposed for use in the grouting operations and inflating inflatable grout seals on a subsea template is disclosed in United Kingdom Pat. No. 2,096,674. In this system for remotely operating a grout system and inflating an inflatable grout seal system, the remote system includes a conduit string suspended from a derrick barge from a cantilevered work platform containing a hydraulic snubbing unit with the conduit string including a remote video camera secured to the conduit string, an orientation jet assembly secured to the conduit string to move the conduit string for insertion into a sleeve receptacle and a stinger assembly located on the end of the conduit string to sealingly engage a portion of the sleeve receptacle to allow fluid transfer thereto. The grouting system attached to the subsea template includes at least one sleeve receptacle which releasably receives a portion of the stinger assembly therein and flow lines interconnecting the sleeve receptacle with at least one annulus between a pile sleeve and a pile driven therethrough. The system also includes an inflation system for inflating an inflatable grout seal located on a pile sleeve from the sleeve receptacle. The inflation system includes a flow line from the sleeve receptacle to the inflatable grout seal on the pile sleeve, the flow line including a check valve and flow control device or means therein and a dummy sleeve receptacle in which the conduit string having the stinger assembly on one end thereof can be placed when it is not being used in either inflating inflatable grout seals or grouting the pile sleeves. Also, a slip joint may be included in the conduit string to compensate for motion of the derrick barge.

While the remote fluid transfer system has desirable features, it also has undesirable ones. For instance, since the hydraulic snubbing unit does not allow for significant horizontal movement of the conduit string, the conduit string must be first positioned at the desired location on the subsea template by moving the derrick barge. Then, the conduit string is guided into the desired receptacle by pumping through the orienting jet assembly. In another instance, since the remote video camera is secured to the conduit string, it has a limited field of view and, more significantly, does not include any position referencing device thereby making it difficult to determine the location of the conduit string with respect to the subsea template and the manner in which the conduit string should be manipulated to insert the stinger assembly into the desired sleeve receptacle. Additionally, since the remote video camera is located on the conduit string the conduit string then must have the video cable secured thereto making it difficult to assemble and manipulate with the slip joint and any safety joint included therein.

All these make the remote fluid transfer system overly complex, not easily subject to manipulation for insertion into the sleeve receptacle, and difficult to use. The system is overly complex because it has all the necessary components assembled into or onto a single conduit string to be manipulated remotely, the system is not easily subject to manipulation because it is suspended from a hydraulic snubbing unit on a cantilevered work platform secured to a derrick barge thereby causing the derrick barge to be moved to position the conduit string over the subsea template, and the system is difficult to use because the remote video camera is secured to the conduit string limiting the field of view of the camera and does not contain any reference system to determine the location of itself and of objects in its field of view.

STATEMENT OF THE INVENTION

In contrast to the prior art, the present invention is directed to a simple, releasable, reuseable, easily manipulated remote transfer system. The apparatus of the present invention directed to the remote fluid transfer system comprises a pumping means, substantially rigid conduit string manipulated by a derrick on the derrick barge, or the like, over the subsea connections to be made, the conduit string including a stinger assembly on the end thereof, and an independently operated and controlled remotely operated vehicle having a video camera thereon. The present invention is also directed to the method of using such apparatus in remote fluid transfer operations as well as the combination of the remote fluid transfer system and the fluid transfer system that it is used with.

The features and advantages of the invention will become more fully apparent from the following detailed description and claims taken in conjunction with the attached drawings.

DESCRIPTION OF THE INVENTION

Figure 1:
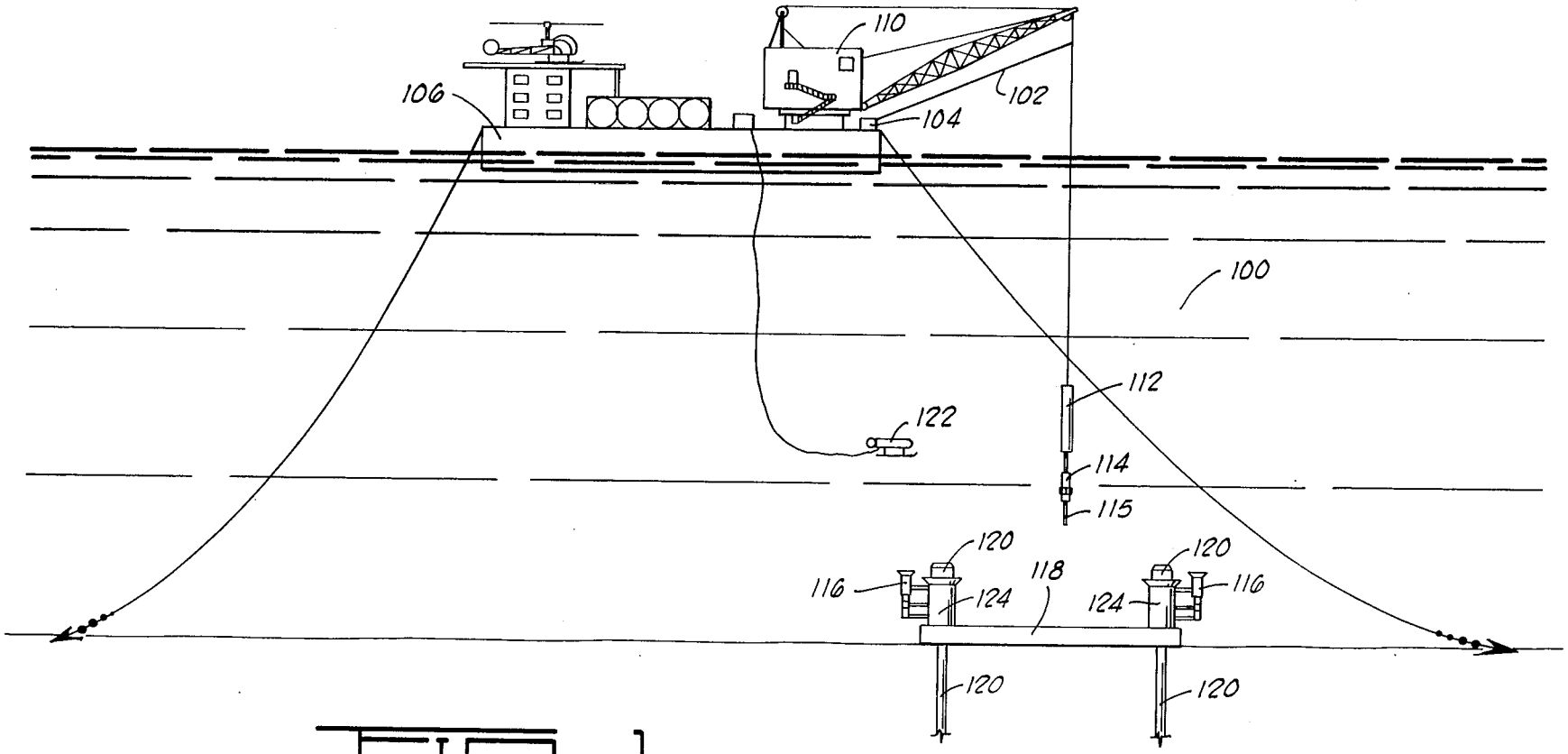
FIG. 1 is a view of the present invention in use in a fluid transfer operation.

Referring to FIG. 1, the remote fluid transfer system 100 of the present invention is shown.

The remote fluid transfer system 100 includes a flexible grout line 102 leading from a mixing and pumping unit 104 located on the deck of a barge 106 to a string 108 of drill pipe or tubing which is substantially rigid and supported and moved by means of a derrick 110 located on the barge 106, a slip joint 112 located in the conduit string 108, a guide member 114 having stinger assembly 115 thereon located on the end of the string 108 of tubing, a guide sleeve receptacle 116 located on a pad 118 secured to the bottom of a body of water by means of piles 120, and remotely operated video camera means 122 to allow the guide member 114 to be inserted into guide sleeve receptacle 116.

The independent remotely operated video camera means 122 may be of any suitable type which is capable of being independently operated from the barge 106 to allow viewing of the manipulation of the tubing string 108 and the insertion of the stinger 115 into guide sleeve receptacle 116. The remotely operated video means should also include an orientation location device to determine the location of the remotely operated video means relative to any object of interest in its field of view.

Similarly, the flexible fluid line 102 may be of any suitable type of rubber hose, or the like which has a sufficient pressure rating for any pumping operations and of sufficient flexibility. Suitable valve means and connector means, not shown, are used to make the connection between the line 102 and conduit string 108. Although substantially rigid drill pipe or tubing is preferred to use in the conduit string 108, in certain instances when it is available in the correct usable lengths, flexible metallic pipe may be used in the place of a conduit string of drill pipe. The flexible metallic pipe is distinguished from reinforced rubber hose because the flexible metallic pipe is heavy due to the metal covering, armor and reinforcement thereon, can withstand large tensile forces thereon, has negative buoyancy, and has sufficient inertia to avoid being easily moved about by currents. Such suitable flexible metallic pipe is sold by Coflexip S.A., Paris, France.

Figure 2:
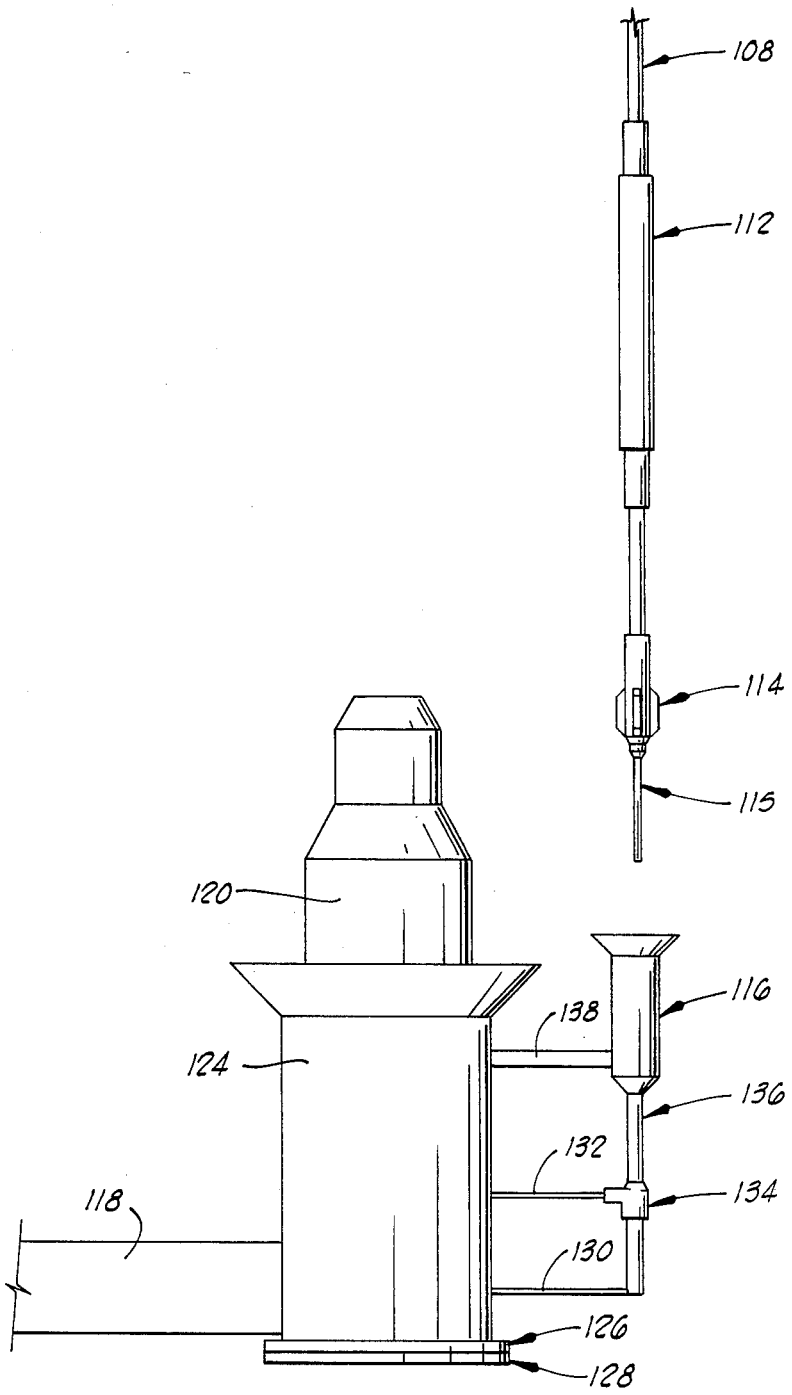
FIG. 2 is a view of a portion of the pipe string and pipe guide sleeve.

Referring to FIG. 2, a portion of the pad 118 having a pile sleeve 124 having a pile 120 driven therethrough and a portion of the remote fluid transfer system 100 is shown.

Secured to the bottom of the pile sleeve 124 is a pile wiper assembly 126 and closure assembly 128 through which the pile 120 is driven. Secured to pile sleeve 124 is guide sleeve 116 which has the outlet thereof connected via fluid lines 130 and 132 to the annular space formed between the pile sleeve 124 and pile 120 driven therethrough. To control the flow of fluid from guide sleeve receptacle 116 to fluid lines 130 and 132 a grout line valve 134 is used. Included at the outlet of guide sleeve receptacle 116 is stinger seal assembly 136 which sealingly engages stinger 115 when the stinger 115 and guide 114 are inserted into the guide sleeve receptacle 116.

Each guide sleeve receptacle 116 comprises a cylindrical housing having a flared upper end to assist in guiding to conduit string 108 thereinto, a closed lower end having conical guide therein having, in turn, a bore therein which receives the end portion of the stinger assembly 115.

The wiper seal 126 may be of any suitable type.

As further shown in FIG. 2, the guide sleeve receptacle 116 is supported and attached to the pile sleeve 124 by means of supports 138.

The slip joint 112 may be of any suitable type such as described on pages 3465 and 3466 of Halliburton Services Sales and Catalog Number 40. The slip joint 112 is utilized to compensate for the up and down movement of the derrick barge 40.

If desired, a safety joint of any suitable type, not shown, may be included in the pipe string to provide a means to separate the remote grouting string should the stinger assembly 15 become stuck in the guide sleeve receptacle 116.

Figure 3:
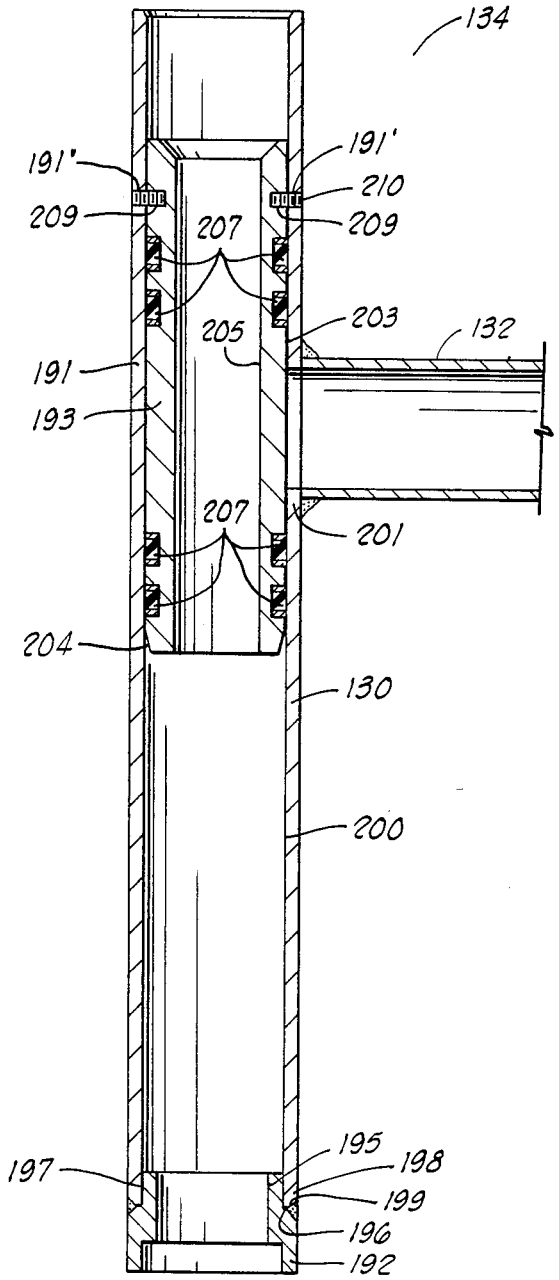
FIG. 3 is a cross-sectional view of the fluid control valve in a first position.

Referring to FIG. 3, the grout valve 134 is shown. The grout valve 134 comprised a housing and a sliding sleeve 193.

Further referring to FIG. 3, the sliding sleeve type valve means 190 is shown. The sleeve valve means 190 comprises a housing and a sliding sleeve 193.

The sleeve valve housing comprises a first member 191 containing the sliding sleeve 193 and a second member 192 which serves as a stop for the sliding sleeve 193. The first member 191 is secured to the fluid line 136 by any convenient means, although welding is preferred.

The second member 192 is secured to the first member 191 and the fluid line 136 (not shown) by any suitable means, although welding is preferred.

As shown, the second member 192 is formed with a bore 195 which communicates with fluid line 130, a shoulder 196 which serves as an abutment for first member 191 and sleeve 193, and cylindrical exterior surface 197 which acts as a pilot when receiving the end of the first member 191. The first member 191 is formed with a portion 198 which is retained on cylindrical exterior surface 197 of the second member, chamfered surface 199 which facilitates welding of the first member to the second member 192 and a bore 200 in which the sleeve 193 slides, and a port 201 associated with the sleeve 193 which communicates with fluid line 136. The fluid lines 136 may be secured to the first member 191 of the housing by any suitable means, although welding is preferred. Also located in the side wall of the first member 191 are threaded bores 191' which receive shear pins 210 therein.

The sleeve 193 is formed with a bore 205, a lower chamfer 204, a bore 205, and upper chamfer 206, a plurality of annular grooves 207 each containing an elastomeric sealing means such as an elastomeric O-ring or elastomeric ring being rectangular in cross-sectional configuration and threaded bores 209 located in the sidewall of the sleeve 193.

The sleeve 193 is held in position in the first member 191 of the sleeve valve housing by means of shear pins 210 threadedly engaging bore 191' in the first member 191 and threaded bores 209 in the sleeve 193. When held in position within the first member 191 of the sleeve valve housing, the sleeve 193 blocks the port 201 to prevent the flow of fluid therethrough.

Figure 4:
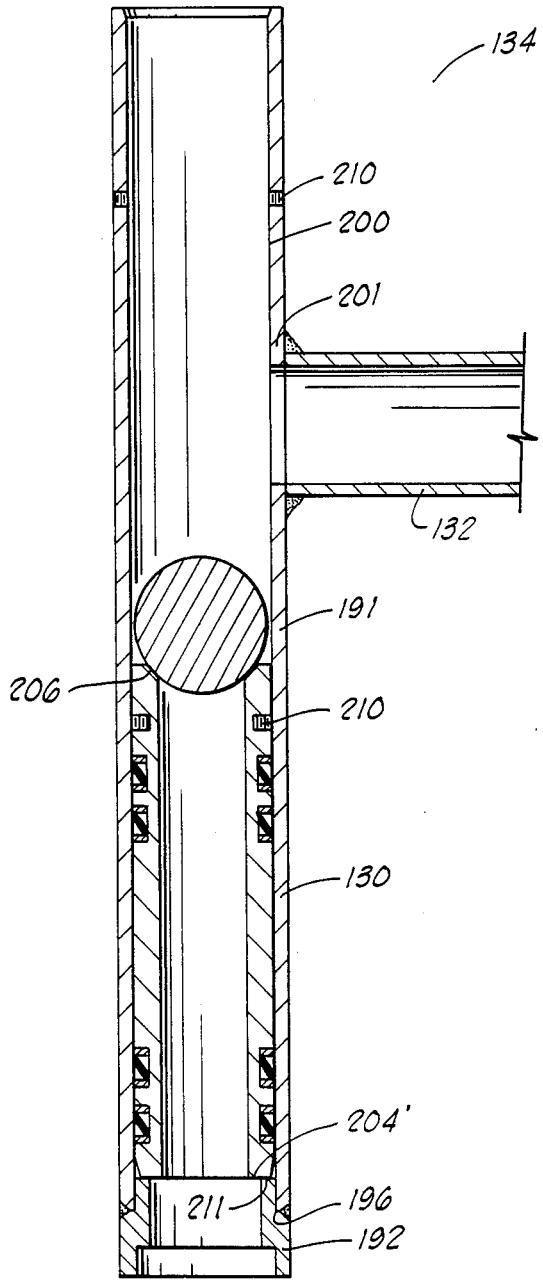
FIG. 4 is a cross-sectional view of the fluid control valve in a second position.

Referring to FIG. 4, to open port 201 to fluid flow a ball, which is slightly smaller than bore 200 in the first member 191, is inserted in fluid line 136 and pumped or allowed to free fall therethrough until it seats on chamfer 206 of the sleeve 193. When the ball has seated on chamfer 206, the pressure in fluid line 136 is increased until the shear pin 210 is sheared thereby freeing sleeve 193 to move downwardly under the inflation liquid or gas pressure until the lower surface 204' abuts shoulder 196 of the second member 192 of the sleeve valve housing. When the sleeve 193 has surface 204' abutting shoulder 211 of the second member 192 of the sleeve valve housing, flow through the sleeve 193 is stopped by the ball sealingly engaging chamfer 206. Any subsequent flow is directed through open port 201 and through fluid line 136.

Although the sliding sleeve type valve means 134 has been illustrated having only one sliding sleeve and one outlet port, the valve means could be formed with any number of sleeves and outlet ports providing that the additional sleeves are of progressively smaller diameter than the last sleeve so that they may be actuated by balls. Additionally, although a sleeve valve means is preferred, any commercially available valve means which can be actuated through the single fluid line 136 to supply fluid to a plurality of pile sleeves to jacket legs may be used either singly or in series in the remote fluid transfer system. Such commercially available valve means includes the use of rupture disk type valve means.

OPERATION OF THE INVENTION

Referring again to FIG. 1, after the piles 120 have been driven through pile sleeves 124 of pad 118 to grout the annulus between the piles and pile sleeves the conduit string 108 having slip joint 112, guide 114 and stinger assembly 115 thereon is assembled and suspended from a derrick 110. The conduit string 108 is connected to the grout mixing and pumping unit 104 by means of flexible grout line 102. In this manner the derrick 110 on the derrick barge 106 may easily, quickly, manipulate the conduit string 108 for insertion of the stinger assembly 115 into any guide sleeve 116. By having the derrick 110 manipulate the string 108 the conduit string 108 may be easily, quickly moved over the pad 118 to any desired guide sleeve receptacle 116 thereon without any movement of the derrick barge 106. Also, by utilizing a substantially rigid conduit string 108 buoyancy problems are eliminated, current drift susceptibility is lessened, and sufficient weight to accurately, easily insert the stinger assembly 115 into guide sleeve receptacle 116 is available.

To insert the stinger assembly 115 into the guide sleeve receptacle 116, the remote video means 122 is used to observe the location of the conduit string 108 and stinger 115 with respect to the guide sleeve receptacle 116 while the derrick 110 manipulates the movement thereof. As the remote video means 122 includes an orientation location device the location of the remote video means 122 may easily determine the location of the conduit string 108 suspended from derrick 110 relative to the guide sleeve receptacle 116 to allow easy insertion of the conduit string 108 having stinger 115 thereon into guide sleeve 116. It must be understood that once the location of the conduit string 108 with respect to the desired guide sleeve receptacle 116 in which it is to be inserted has been determined, the manner in which the conduit string 106 is to be moved must be communicated from the video display viewing area on the derrick barge 106 to the derrick 110 to allow coordination of the manipulation of the conduit string 108. Once the stinger assembly 115 and guide 114 are inserted into the guide sleeve receptacle 116 and stinger seal 136 sealingly engages the stinger assembly 115, any desired fluid may be then pumped to grout the annulus between the piles 120 and pile sleeves 124.

Initially, a predetermined amount or volume of grout is pumped through conduit string 108 and fluid line 130 into the annulus between the pile 120 and pile sleeve 124. The amount or volume of grout pumped into annular space between pile 120 and sleeve 124 is not sufficient to cover the inlet port where line 132 enters sleeve 124 thereby allowing the first stage of grout to set up before pumping the second stage of grout through line 132. The wiper seal at the bottom of sleeve 124 sleeve 126 prevents grout from exit of sleeve 124.

When it is desired to pump grout into the annulus between the pile 120 and pile sleeve 124 through grout line 132, a ball is pumped through tubing string 108 to shift the sleeve 193 in grout valve 134 as previously described. After a sufficient predetermined amount of grout has been pumped into the annulus between the pile 120 and pile sleeve 124, the stinger 115 and guide 114 are removed from the guide sleeve receptacle 116 and inserted into another guide sleeve receptacle 116 if the system is operated in such a manner, to continue grouting operations.

After all grouting operations are finished, the stinger assembly 115 is removed from the seal and water is pumped through the flexible grout line 102, conduit string 108, slip joint 112, guide 114, and stinger assembly 115 to clean the grout therefrom.

If desired, any suitable check valve may be included in either fluid line 130 or 132 to control the flow of grout from the annulus between the pile 120 and pile sleeve 124.

It should be understood that although the invention has been described with respect to a derrick barge 106, a dynamically positioned drill ship could be used rather than the derrick barge 106. In that instance, it would probably not be necessary to use a slip joint in the conduit string as drill ships have pipe compensation devices permanently mounted thereon to compensate for wave motion of the drill ship.

The present invention also contemplates the situation where the derrick barge has installed a jacket, driven piling to secure the jacket to the sea floor, and installed the top of the platform on the jacket. When the jacket contains a remote grouting and inflation system for grouting the jacket and inflating inflatable grout seals installed on the jacket it may be necessary to place a movable derrick on the top of the platform to manipulate the substantially rigid conduit string having stinger assembly thereon and independent remote video means to engage guide sleeve receptacles on the jacket to grout and inflate the inflatable seals.

Also, different types of valve arrangement may be utilized, if desired, as well as the invention be used to inflate packers or in place of or in addition to grouting the pad 118 or any fluid transfer operation necessary for the pad 118.

Other modifications and changes to the invention will be apparent to skilled in the art. Accordingly, all changes or modifications which come within the meaning and range of equivalency of the claims are to be embraced within their scope.

Having thus described our invention, we claim:

1. A fluid transfer system for a marine structure located in a body of water for remotely transferring fluid to said marine structure from a vessel located on the surface of said body of water being anchored in position near said marine structure, said fluid transfer system comprising:

pump means located on said vessel to pump said fluid from said vessel to said marine structure;

flexible conduit means having one end thereof connected to the pump means located on said vessel, substantially rigid conduit means extending from said vessel to said marine structure to provide a flow path for said fluid to be transferred from said vessel to said marine structure, the substantially rigid conduit means having one end thereof connected to the other end of the flexible conduit means;

independent video camera means for observing the location of the substantially rigid conduit means in said body of water;

independent manipulation means located on said vessel for manipulating the substantially rigid conduit string over a substantial portion of said marine structure without movement of said vessel from its anchored position over said marine structure, the independent manipulation means having a portion thereof secured to a portion of the substantially rigid conduit string;

stinger assembly means connected to the other end of the substantially rigid conduit means; and a fluid transfer system means including:

at least one sleeve means which releasably receives a portion of the stinger means therein; and flow line means interconnecting the sleeve means with another portion of said marine structure transfer said fluid from the conduit means to said marine structure.

2. The fluid transfer system of claim 1, wherein the conduit means includes:

slip joint means to allow movement between said vessel and said marine structure.

3. The fluid transfer system of claim 1, wherein the fluid transfer system further includes:

valve means located in the flow line interconnecting the sleeve means with another portion if said marine structure.

4. The fluid transfer system of claim 1 further comprising:

second flow line means connected to another portion of said marine structure and to the sleeve means.

5. The fluid transfer system of claim 1 further comprising:

video receiver means connected to the independent video camera means.

6. The fluid transfer system of claim 1 wherein said vessel is a derrick barge.

7. A grouting system for a marine structure for remotely grouting the annulus between a pile sleeve of said marine structure and a pile driven therethrough, said system comprising;

pump means to pump said grout to said marine structure for remotely grouting said annulus between a pile sleeve of said marine structure and a pile driven therethrough;

flexible conduit means having one end thereof connected to the pump means for pumping said grout;

substantially rigid, independently movable conduit means extending form said marine structure to provide a flow path for said grout, the substantially rigid, independently movable, conduit means having one end thereof connected to the other end of the flexible conduit means;

independently manipulation means located on the other end of the substantially rigid, independently movable, conduit means; and grouting system means including:

at least one sleeve means w which releasably receives a portion of the stinger means therein; and flow line means interconnecting the sleeve means with at least one said annulus between a pile sleeve and a pile driven therethrough.

8. A system according to claim 7, wherein the remote grouting string means further includes:

slip joint means.

9. A system according to claim 7 wherein grouting system means further comprises:

valve means located in the flow line means interconnecting connecting the sleeve means with said annulus between a pile sleeve and a pile driven therethrough.

10. A system according to claim 7 further comprising:

second flow line means connected to the annulus between the pile sleeve having a pile driven therethrough having a valve means installed therein.

11. A system according to claim 7 further including:

video receiver means connected to the remote video camera means.

12. A method of remotely transferring fluid to a marine structure located in a body of water from a vessel located on the surface of said body of water, the marine structure having at least one sleeve receptacle thereon and having flow line means thereon having, in turn, flow control valve means installed therein, the method comprising the steps of:

providing a flexible conduit member;

providing a string of substantially rigid conduit members;

providing a stinger assembly means to be connected to the string of substantially rigid conduit members;

providing a pump means to pump said fluid under pressure to said marine structure;

assembling the stringer assembly means to a portion of the string of substantially rigid conduit members;

assembling a complete string of substantially rigid conduit members having the stringer assembly means on one end thereof to mate with a portion of said sleeve receptacle when inserted therein;

connecting one end of the flexible conduit member to the pump means;

connecting the other end of the flexible conduit member to the string of substantially rigid conduit members;

suspending the assembled string of substantially rigid conduit members from a derrick located on said vessel;

manipulating the string of substantially rigid conduit members using the derrick on said vessel to engage the stinger assembly means on the end of the string of substantially rigid conduit members to engage a portion of said sleeve receptacle; and pumping fluid through the string of substantially rigid conduit members into said sleeve receptacle.

13. The method of claim 12 further comprising the step of:

observing the manipulation of the string of substantially rigid conduit members by means of an independently controlled observation means having a location indicator thereon.

14. The method of claim 13 further comprising the steps of:

modifying the manipulation of the string of substantially rigid conduit members in response to the observation of the string of substantially rigid conduit members to attempt to cause the engagement of the stinger on one end of the string of substantially rigid conduit members with a portion of said sleeve receptacle on said marine structure.

15. The method of claim 14 further comprising the step of:

removing the stinger on one end of the string of substantially rigid conduit members from said sleeve receptacle after pumping fluid therethrough.

16. The method of claim 15 further comprising the step of:

flushing any undesirable fluid from the string of substantially rigid conduit members.

17. A method of remotely grouting a marine structure located in a body of water having piling drived therethrough to secure said marine structure to the floor of said body of water from a vessel located on the surface of said body of water, the marine structure having at least one sleeve receptacle thereon and having flow line means thereon having, in turn, flow control valve means installed therein, the method comprising the steps of:

providing a flexible conduit member;

providing a string of substantially rigid conduit members;

providing a stinger assembly means to be connected to the string of substantially rigid conduit members;

providing a pump means to pump said fluid under pressure to said marine structure;

assembling the stinger assembly means to a portion of the string of substantially rigid conduit members;

assembling a complete string of substantially rigid conduit members having stinger assembly means on one end thereof to mate with a portion of said sleeve receptacle when inserted therein;

connecting one end of the flexible conduit member to the pump means;

connecting the other end of the flexible conduit member to the string of substantially rigid conduit members;

suspending the assembled string of substantially rigid conduit members from a derrick located on said vessel;

manipulating the string of substantially rigid conduit members using the derrick on said vessel to engage the stinger assembly means on the end of the string of substantially rigid conduit members to engage a portion of said sleeve receptacle; and pumping a first fluid through the into said receptacle; and pumping a second fluid through the string of substantially rigid conduit members into a said receptacle to fill a portion of said marine structure to retain said marine structure secured to said piling driven therethrough.

18. The method of claim 17 further comprising the step of:

observing the manipulation of the string of substantially rigid conduit members by means of an independently controlled observation mean having a location indicator thereon.

19. The method of claim 18 further comprising the step of:

modifying the manipulation of the string of substantially rigid conduit members to response to the observation of the string of substantially rigid conduit members to attempt to cause the engagement of the stinger on one end of the conduit string with a portion of said sleeve receptacle on said marine structure.

20. The method of claim 19 further comprising the step of:

flushing the second fluid from the string of substantially rigid conduit members.

* * * * *

UNITED STATES PATENT AND TRADEMARK OFFICE

CERTIFICATE OF CORRECTION

PATENT NO. : 4,789,271

DATED : December 6, 1988

INVENTOR(S) : Bob L. Sullaway et al.

It is certified that error appears in the above-identified patent and that said Letters Patent is hereby corrected as shown below:

In column 1, line 43, after the word "annulus", insert --.--.

In column 2, line 51, delete theword [an] and insert therefore --and--.

In column 10, line 6, delete the word [form] and insert therefore --from--.

In column 10, line 15, after the word means, delete the letter [w].

In column 10, line 26, after the word "interconnecting", delete the word [connecting].

In Column 12, line 29, delete the word [mean] and insert therefore --means--.

Signed and Sealed this

Eighteenth Day of April, 1989

*Attest:*

*Attesting Officer*

DONALD J. QUIGG

*Commissioner of Patents and Trademarks*